US005813051A

United States Patent [19]

Counter

[11] Patent Number: 5,813,051

[45] Date of Patent: Sep. 29, 1998

[54] GARMENT HAVING REMOVABLE PATCH

[76] Inventor: David C. Counter, 2815 SW. 31st St Ct., Apt. 308, Topeka, Kans. 66614

[21] Appl. No.: 819,780

[22] Filed: Mar. 18, 1997

Related U.S. Application Data

[60] Provisional application No. 60/033,932 Mar. 18, 1996.

[51] Int. Cl.[6] ..... A41D 1/00

[52] U.S. Cl. ..... 2/69; 2/108; 2/102; 2/115

[58] Field of Search ..... 2/69, 79, 115, 2/102, 108, 93, 94, 85, 227, 228, 244, 246, 243.1, 912–919; 40/586, 636, 640

[56] References Cited

U.S. PATENT DOCUMENTS

| | | | |
|---|---|---|---|
| 1,436,854 | 11/1922 | Brady | 40/586 |
| 2,527,258 | 10/1950 | Kahn | 2/115 |
| 2,647,261 | 8/1953 | Rassner | 2/115 |
| 2,685,690 | 8/1954 | Chrisman | 2/115 |
| 2,821,035 | 1/1958 | Joseph | 40/586 |
| 2,936,460 | 5/1960 | Jackson | 40/586 |
| 4,924,613 | 5/1990 | Levin | 40/586 |
| 4,969,214 | 11/1990 | Cohen | 2/115 |
| 5,086,516 | 2/1992 | Baxter et al. | 2/108 |
| 5,581,815 | 12/1996 | Hans | 2/115 |

*Primary Examiner*—Gloria M. Hale
*Attorney, Agent, or Firm*—Hovey, Williams, Timmons & Collins

[57] ABSTRACT

The present invention is broadly directed toward a garment (10) including a body having an outwardly facing portion (20) and a flap (22) provided on the outwardly facing portion (20) of the garment (10) for retaining a patch (12) on the garment (10). Fastening structure (30, 38) is provided on each of the flap (22) and outwardly facing portion (20), and corresponding fastening structure (52) is provided on the patch (12). The fastening structure (30, 38, 52) is adapted to hold the patch (12) between the flap (22) and outwardly facing portion (20) for retaining the patch (12) to the garment (10). The patch (12) also includes a pair of belts (48, 50) for preventing unwanted removal of the patch (12) from the garment (10). Each of the belts (48, 50) includes a coupling member (56, 58) configured for engagement with corresponding coupling members (60, 62) positioned in the garment (10).

7 Claims, 1 Drawing Sheet

GARMENT HAVING REMOVABLE PATCH

RELATED APPLICATION

The benefit of the following Provisional Patent Application is claimed: Serial No. 60/033,932, filed Mar. 18, 1996, and entitled LOGOUPDATE-REMOVEABLE LOGO PATCH FOR GARMENT.

BACKGROUND OF THE INVENTION

1. Field of the Invention

The present invention relates to the field of garments, and more particularly a garment having a removable patch for displaying various indicia. The garment constructed in accordance with the present invention includes an improved means for removably retaining the patch to the garment.

2. Background of the Invention

Various types of garments are known that include indicia emblazoned on a portion of the garment for displaying the indicia to signify an allegiance or affiliation with a cause or group. For example, a relatively large number of jackets are sold bearing the logos of sports teams. Such jackets are relatively expensive. Therefore, if an individual desires to alternatively display several different logos, such as if the person alternatively attended baseball and football games, the individual would be required to buy a jacket corresponding to each team.

Several devices are known in the prior art that permit the removal and replacement of a patch bearing unique indicia with another patch bearing different indicia. For example, U.S. Pat. No. 2,647,261 to Rassner shows a sport shirt having a detachable insignia panel or patch. The shirt includes a plurality of fastening elements for fastening the panel to the back of the shirt. Should the individual chose to wear the shirt without the panel, the fastening elements are unattractively exposed. Therefore, the shirt of the '261 patent is not configured to be worn without the panel attached.

U.S. Pat. No. 5,086,516 to Baxter et al. is also directed toward a garment having a detachable patch. The garment includes strips of hook and loop material that are engageable by strips of corresponding hook and loop material provided on the patch. Since the strips of hook and loop material provided on the garment are permanently attached, the garment of the '516 patent is also not configured to be worn without the patch attached.

In addition, the garments of the '261 and '516 patents do not provide a means for preventing unwanted removal of the patch. Therefore, the patches of the '261 and '516 patents may be stolen while attached to the respective garments.

As a result, a significant and heretofore unsolved need exists to provide a garment having a removable patch and an improved means for removably retaining the patch to the garment so that the patch may be easily removed and so that the garment may be worn without the patch. Also, a need exists to provide a garment having a means for preventing unwanted removal of the patch from the garment.

SUMMARY OF THE INVENTION

The present invention addresses the above noted problems in the prior art and represents a significant advance in the state of the art of garments having a removable patch bearing indicia. In broad terms, the garment includes a body having an outwardly facing portion and a means for removably retaining a patch.

In a preferred form, the retaining means includes a flap provided on the outwardly facing portion of the garment. Fastening structure is provided on each of the flap and outwardly facing portion, and corresponding fastening structure is provided on the patch. The patch is held between the flap and outwardly facing portion for retaining the patch on the garment.

The patch also includes a pair of belts for preventing unwanted removal of the patch from the garment. Each of the belts includes a coupling member configured for engagement with corresponding coupling members positioned in the garment.

DESCRIPTION OF THE DRAWING FIGURES

DETAILED DESCRIPTION OF THE PREFERRED EMBODIMENT

Figures 1, 2, 3, 4:
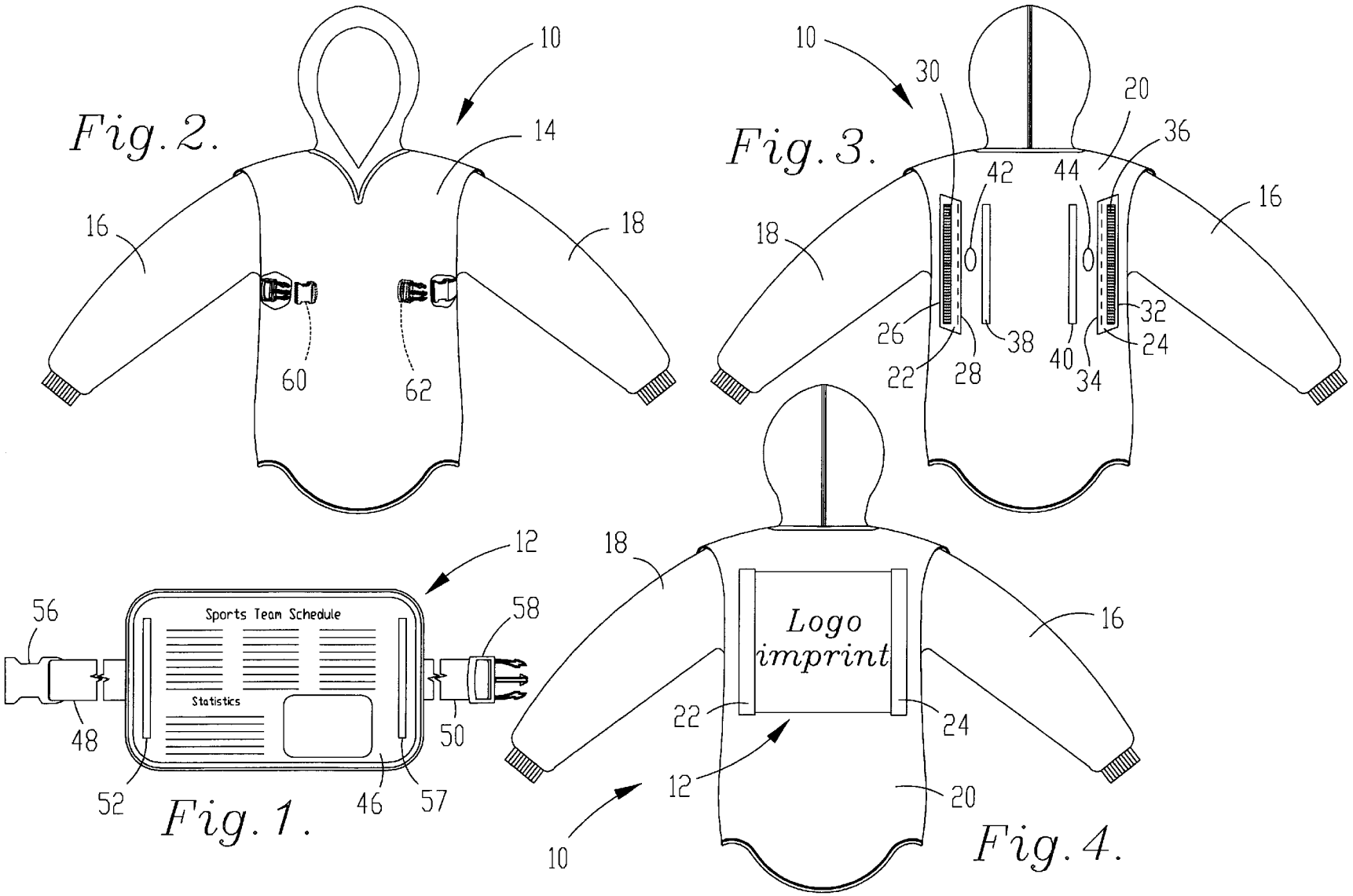
FIG. 1 is an elevational view of a removable patch of the present invention.
FIG. 2 is a front elevational view of a garment constructed in accordance with a preferred embodiment of the present invention.
FIG. 3 is a rear elevational view of the garment of FIG. 2.
FIG. 4 is a rear elevational view of the garment of FIG. 2 showing a patch attached to the garment.

Referring now to FIG. 2, a garment 10 is shown constructed in accordance with a preferred embodiment of the present invention. The garment 10 is configured to removably retain a patch 12, shown in FIG. 1, for presenting indicia displayed on the patch 12. As illustrated in the figures, garment 10 is a hooded pull-over jacket. It is noted that garment 10 may alternatively be any other type of jacket or article of clothing. In addition, it is noted that garment 10 may be constructed from any appropriate clothing material, such as natural or synthetic fibers, leather, vinyl, etc.

The preferred garment 10 includes a front portion 14, sleeves 16, 18 and a back portion 20, shown in FIG. 3. A pair of elongated flaps 22, 24 are provided on the back portion 20 of the garment 10 for retaining the patch 12 to the garment 10. Flap 22 includes opposed edges 26, 28 and a strip 30 of hook and loop material. Similarly, flap 24 includes opposed edges 32, 34 and a strip 36 of hook and loop material.

Flaps 22, 24 are attached to the back portion 20 of the garment 10 adjacent to elongated edges 28, 34, respectively, to present living hinges therebetween. Strips 38, 40 of hook and loop material are attached to the back portion 20 of the garment 10 and are engageable by strips 30, 36. An opening 42 is formed in back portion 20 intermediate flap 22 and strip 38. In addition, an opening 44 is formed in back portion 20 intermediate flap 24 and strip 40.

Referring now to FIG. 1, the patch 12 presents a front face 46 and an opposed rear face (not shown). Indicia is presented on the front face 46 of the patch 12. Patch 12 further includes a pair of belts 48, 50 and strips 52, 57 of hook and loop material attached to the front face 46. The strips 52, 57 are engageable by strips 30, 36 of flaps 22, 24, respectively. A pair of strips of hook and loop material are additionally attached to the rear face. The rear face strips are configured for engaging strips 38, 40 of the back portion 20. As a result, the patch 12 is configured to be positioned on the back portion 20 so that the rear face strips engage strips 38, 40 and the flaps 22, 24 are closed over the edges of the patch 12 so that flap strips 30, 36 engage front face strips 52, 57 to retain patch 12 to garment 10, as shown in FIG. 4.

As shown in FIG. 1, belt 48 includes female coupling member 56 and belt 50 includes male coupling member 58. Belts 48, 50 are configured to be received through openings 42, 44, respectively, and around the torso of the wearer of garment 10. Female coupling member 60 is provided inside garment 10 and is adapted to engage belt coupling member 58. Male coupling member 62 is provided inside garment 10 and is adapted to engage belt coupling member 56. By coupling members 60 and 58, and 62 and 56, the patch 12 is securely retained on garment 10. As a result, patch 12 may not be removed by a would be thief while garment 10 is worn.

It will be appreciated that the patch 12 may be easily removed from garment 10 and replaced with another patch bearing different indicia. As a result, an individual gains the utility of owning several garments bearing different indicia while expending little more than the cost of a single garment.

In addition, the inventive means for retaining the patch 12 to the garment 10 permits an individual to wear the garment 10 without a patch 12 attached. For example, when no patch 12 is attached to garment 10, flap 22 may be positioned so that flap strip 30 couples with strip 38 and covers opening 42. Similarly, flap 24 may be positioned so that flap strip 36 couples with strip 40 and opening 44 is covered.

The present invention has been described with reference to the illustrated preferred embodiment. It is noted, that changes and variations may be made, and alternatives or equivalents employed without departing from the scope of the invention as set forth in the claims.

What is claimed is:

1. A garment comprising:

a body having an outwardly facing portion;

an elongated flap presenting a pair of opposed elongated edges, one of the elongated edges of the flap being attached to the outwardly facing portion of the garment;

a removable patch presenting opposed faces and first and second side edges, the patch bearing indicia on at least one of the faces; and a retaining means for removably retaining one of the side edges of the patch between the flap and the outwardly facing portion, the retaining means including fastening structure mounted on each of the faces of the patch and corresponding fastening structure mounted on the flap and the outwardly facing portion.

2. The garment as set forth in claim 1, wherein the fastening structure mounted on the faces of the patch and the corresponding fastening structure mounted on the flap and outwardly facing portion are constructed from hook and loop material.

3. The garment as set forth in claim 1, further including a second flap spaced from the first flap, the second flap presenting a pair of opposed edges, one of the edges of the second flap being attached to the outwardly facing portion of the garment, the retaining means further including fastening structure mounted on the faces of the patch adjacent to the second edge thereof and corresponding fastening structure mounted on the second flap and the outwardly facing portion adjacent to the second flap.

4. A garment comprising:

a body having an outwardly facing portion;

a flap presenting a pair of opposed edges, one of the edges of the flap being attached to the outwardly facing portion of the garment;

a removable patch presenting opposed faces and first and second side edges, the patch bearing indicia on at least one of the faces;

a retaining means for removably retaining one of the side edges of the patch between the flap and the outwardly facing portion, the retaining means including fastening structure mounted on each of the faces of the patch and corresponding fastening structure mounted on the flap and outwardly facing portion; and an opening formed in the outwardly facing portion of the body between the flap and fastening structure mounted on the outwardly facing portion, and a garment coupling member positioned inside the garment body, the patch further including a belt adjacent to one of the side edges, the belt including a belt coupling member, the belt coupling member being adapted to be received through the opening for engaging the garment coupling member for selectively securing the patch to the garment.

5. A garment comprising:

a body having an outwardly facing portion;

a flap presenting a pair of opposed edges, one of the edges of the flap being attached to the outwardly facing portion of the garment;

a removable patch presenting opposed faces and first and second side edges, the patch bearing indicia on at least one of the faces;

a retaining means for removably retaining one of the side edges of the patch between the flap and the outwardly facing portion; and means for selectively securing the patch to the garment, the securing means including a garment coupling member positioned inside the garment body and a belt attached to the patch, the belt having a coupling member configured for engaging the garment coupling member.

6. The garment as set forth in claim 5, wherein the retaining means includes: fastening structure mounted on each of the faces of the patch, and corresponding fastening structure mounted on the flap and outwardly facing portion; and the fastening structure being constructed from hook and loop material.

7. The garment as set forth in claim 5, further including a second flap spaced from the first flap, the second flap presenting a pair of second opposed edges, one of the second edges of the second flap being attached to the outwardly facing portion of the garment, the retaining means further including fastening structure mounted on the faces of the patch adjacent to the second side edge thereof and corresponding fastening structure mounted on the second flap and the outwardly facing portion adjacent to the second flap.

* * * * *